United States Patent [19]

De La Rosa

[11] Patent Number: 4,659,072

[45] Date of Patent: Apr. 21, 1987

[54] KNITTING MACHINE HEAD EXTRACTOR

[76] Inventor: Roberto De La Rosa, 3038 Atlantic Ave., Brooklyn, N.Y. 11208

[21] Appl. No.: 598,068

[22] Filed: Apr. 9, 1984

[51] Int. Cl.[4] ..... B23K 7/10

[52] U.S. Cl. ..... 269/17; 269/60; 269/61; 269/76

[58] Field of Search ..... 29/252, 256, 259, 260; 254/84, 85, 2-B, 2 R; 269/71, 76, 60, 61, 17

[56] References Cited

U.S. PATENT DOCUMENTS

| | | | |
|---|---|---|---|
| 1,823,204 | 9/1931 | Long | 269/71 |
| 2,188,433 | 1/1940 | Friese | 269/71 |
| 3,588,046 | 6/1971 | Weaver | 254/85 |
| 4,317,560 | 3/1982 | Troyer | 269/60 |
| 4,465,424 | 8/1984 | Inaba et al. | 414/589 |

*Primary Examiner*—Robert C. Watson
*Attorney, Agent, or Firm*—Richard L. Miller

[57] ABSTRACT

A knitting machine head extractor for flat knitting machines which permits the easy removal of heavy knitting machine heads while still permitting the operation of the head while still connected electrically to the base for ease of servicing. Knitting machine heads of various widths may be clamped into position and rotated along a horizontal axis. The head may be raised or lowered using a hydraulic or pneumatic pump. A heavy base with easy to operate trolley system, mounted on heavy-duty roller casters permits additional freedom of movement.

8 Claims, 3 Drawing Figures

KNITTING MACHINE HEAD EXTRACTOR

BACKGROUND OF THE INVENTION

The instant invention relates generally to industrial servicing fixtures and, more specifically, to knitting machine head extractors which lift knitting machine heads off benches and safely hold them in position for servicing.

At the present state of the art knitting machine heads must be removed by hand. Only an expert mechanic with strong arms, back and legs can remove a knitting head from a knitting base. Even when performed by an expert mechanic there remains a risk of damaging the machine head while it is being removed from the base. The internal mechanism of these electronic machines cannot be viewed in operation while off the knitting machine base as removal presently requires the disconnection of cables. The mechanic is often forced to work on the knitting machine head in the immediate area of the knitting machine base because the knitting head is too cumbersome to be moved to a more desirable work area.

SUMMARY OF THE INVENTION

It is therefore a primary object of the present invention to provide a knitting machine head extractor for flat knitting machines in which a knitting head may be extracted easily and moved and rotated to a convenient position which allows the operation of the knitting machine head at any angle with cables attached.

A further object is to provide a knitting machine head extractor for flat knitting machines which is stable and may be rolled to a convenient location. This is accomplished by using a heavy base mounted on roller casters.

Another object is to provide a knitting machine head extractor for flat knitting machines in which the knitting machine head may be moved laterally yet remains fixed in position once set. This is accomplished by a trolley and threaded crank shaft system. The correct lateral position of the knitting machine head also assures that the center of gravity is located directly above the center of the base thereby adding to the stability of the system.

A further object is to provide a knitting machine head extractor for flat knitting machines in which the knitting machine head may be raised or lowered. This is accomplished by use of a hydraulic or pneumatic jack operated by a jack handle.

A still further object is to provide a knitting machine head extractor for flat knitting machines in which the knitting machine head is clamped firmly to a fork lift arrangement supported by the aforementioned hydraulic or pneumatic jack.

A yet further object is to provide a knitting machine head extractor for flat knitting machines in which the knitting machine head may be rotated along a horizontal axis so that the knitting machine head, clamped as already described, can be operated in any position with cables still attached.

A yet further object is to provide a knitting machine head extractor for flat knitting machines which can securely hold knitting machine heads of varying widths.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
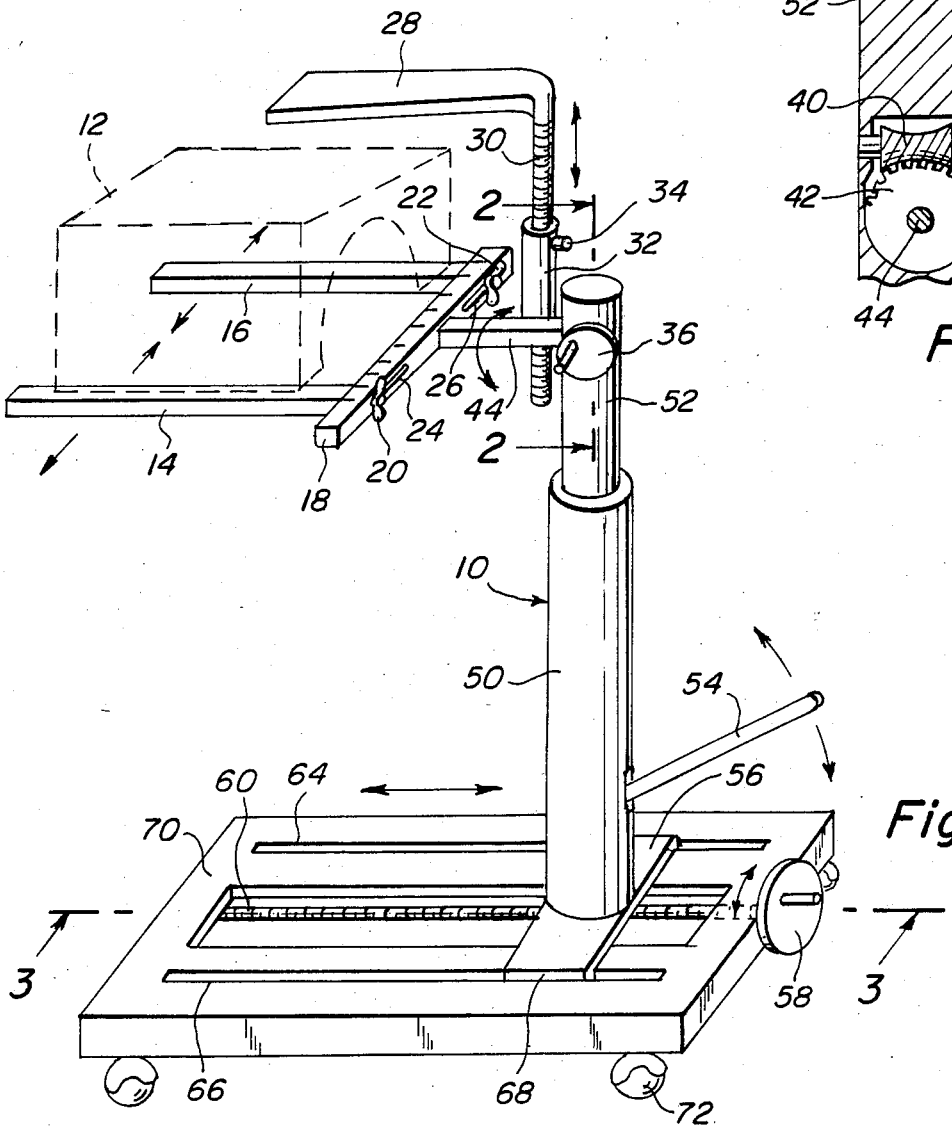
FIG. 1 is a perspective view of the invention with a surmounted knitting machine head shown in phantom.

A knitting machine head 12 is seen in FIG. 1 placed upon the invention 10. The knitting machine head 12 rests upon fork rails 14 and 16 which slide into a rectangular track formed in fork lift cross arm 18. Threaded shafts with wing nuts 20 and 22 are provided at the ends of fork rails 14 and 16. The separation of fork rails 14 and 16 may be adjusted by moving them along the slots 24 and 26 provided in fork lift cross arm 18.

Knitting machine head 12 is locked securely in place by head clamp 28 which is in turn locked into place by head clamp extension arm 30 which fits into extension arm socket 32. A clamp lock 34 is also provided.

Figure 2:
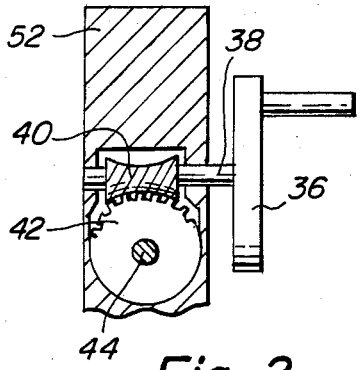
FIG. 2 is a partial enlarged cross sectional view taken on line 2—2 in FIG. 1.

The knitting machine head 12 may be rotated along the horizontal axis by a worm and pinion gear arrangement which may best be understood with reference to FIG. 2. When crank handle 36 is turned, crank shaft 38 and worm gear 40 also rotate. Worm gear 40 meshes with pinion gear 42 which causes rotating arm 44 to rotate along a horizontal axis. Since fork lift cross arm 18 is directly connected to rotating arm 44 the entire fork lift assembly and thereby the knitting machine head 12 rotate as well.

The knitting machine head 12 may also be moved up and down using a pneumatic, or hydraulic jack system comprising a pump cylinder 50, pump piston 52 and a pump handle 54.

Figure 3:
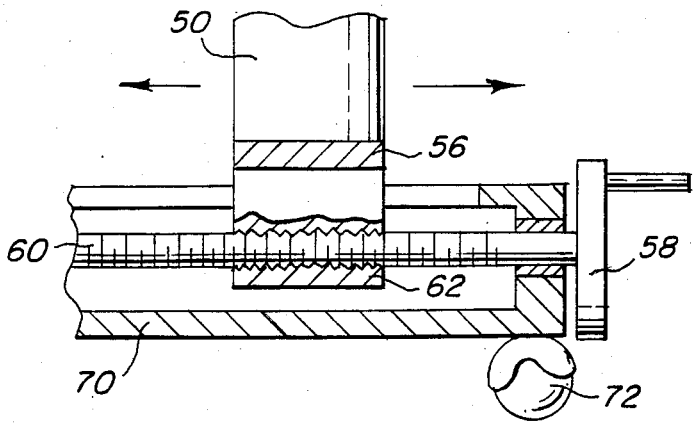
FIG. 3 is partial enlarged cross sectional view taken on line 3—3 in FIG. 1.

The entire pump assembly as described above, is mounted on a trolley 56 which permits lateral, controlled, movement. This trolley system may best be understood with reference to FIG. 3. When crank handle 58 is rotated threaded crank shaft 60 rotates as well. Since crank shaft 60 meshes with threaded crank shaft guide 62, which is an integral part of trolley 56 the trolley moves slowly back and forth. Parallel trolley tracks 64 and 66 are provided into which two trolley guides, typified by 68, may slide. This guide system limits trolley travel and allows only lateral movement.

The entire device is supported by a heavy base 70 which may be typically cast from iron or steel. Four heavy duty roller casters, typified by 72 allow facile movement of the instant invention 10 even with a heavy knitting machine head surmounted.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A knitting machine head extractor for flat knitting machines, comprising in combination:

(a) a heavy stable base on roller casters;

(b) means for supporting knitting machine heads of varying width, including two fork rails placed parallel to each other which support said knitting head, wherein said fork rails are attached to a fork lift cross arm, and means for moving each of said fork rails independently of the other;

(c) means for moving said knitting machine head laterally in a direction parallel to a horizontal plane;

(d) means for clamping said knitting machine head to said knitting meachine head extractor, including a head clamp, a perpendicular head clamp extension arm, and an extension arm socket with associated clamping lock, whereby said head clamp can be adjusted independently of said fork rails;

(e) means for raising and lowering said knitting machine head; and (f) means for rotating said knitting machine head about a horizontal axis while said knitting machine head remains electrically connected therby allowing direct access to the underside of said knitting machine head while said knitting machine head is operable, and means for restricting said rotation to a limited arc to prevent the knitting head from sliding off the fork rails.

2. A knitting machine head extractor for flat knitting machines, as recited in claim 1, wherein said fork lift cross arm is shaped as an elongated rectangular box with one long edge open thereby forming a track into which said fork rails may slidably move.

3. A knitting machine head extractor for flat knitting machines, as recited in claim 1, wherein one end of each of said fork rails is equipped with a threaded shaft which engages elongated slots in said fork lift cross arm, whereby each of said fork rails may be independently positioned and then locked into place with a wing nut after said fork rails are adjusted to match the width of a particular said knitting head.

4. A knitting machine head extractor for flat knitting machines, as recited in claim 1, wherein means for moving said knitting machine head laterally in a direction parallel to the horizontal plane comprises a trolley in which a crank handle rotates a threaded crank shaft in said base which is passes through a threaded crank shaft guide in said trolley whereby when said crank handle is rotated said trolley moves in a direction parallel to the horizontal plane.

5. A knitting machine head extractor for flat knitting machines, as recited in claim 4, further comprising two parallel tracks running along the length of the top surface of said base and corresponding trolley guides which extend downward from said trolley into said parallel tracks such that when said crank is rotated and said trolley moves laterally the direction and extent of trolley travel is limited by said tracks and guides.

6. A knitting machine head extractor for flat knitting machines, as recited in claim 1, wherein means for raising and lowering said knitting machine head comprises a hydraulic jack with associated fluid cylinder, piston rod and pump handle.

7. A knitting machine head extractor for flat knitting machines, as recited in claim 1, wherein means for raising and lowering said knitting machine head comprises a pneumatic jack with associated fluid cylinder, piston rod and pump handle.

8. A knitting machine head extractor for flat knitting machines, as recited in claim 1, wherein means for rotating said knitting machine head along a horizontal axis while said knitting machine head remains electrically connected thereby allowing direct access to the underside of said knitting machine head while said knitting machine head is operable comprises a worm and pinion gear arrangement for a limited arcuate interval such that said worm gear and associated crank shaft and crank handle are an integral part of a rod piston, coaxial to a fluid cylinder, which sits upon a trolley mounted to said base; and said worm gear is attached to a rotating arm attached perpendicularly to a fork lift cross arm to which a knitting machine head may be temporarily mounted whereby when said crank handle is rotated said knitting machine head will likewise rotate about a horizontal axis.

* * * * *